US008104548B2

(12) United States Patent
Ma et al.

(10) Patent No.: US 8,104,548 B2
(45) **Date of Patent: *Jan. 31, 2012**

(54) SHAPE MEMORY ALLOY ACTUATED STEERABLE DRILLING TOOL

(75) Inventors: Ning Ma, Santa Clara, CA (US); Ralf J. Muller, El Dorado (TT); Leyland Smith, The Woodlands, TX (US)

(73) Assignee: Cyrus Solutions Corporation, The Woodlands, TX (US)

( * ) Notice: Subject to any disclaimer, the term of this patent is extended or adjusted under 35 U.S.C. 154(b) by 19 days.

This patent is subject to a terminal disclaimer.

(21) Appl. No.: 12/620,387

(22) Filed: Nov. 17, 2009

(65) Prior Publication Data

US 2010/0108382 A1 May 6, 2010

Related U.S. Application Data

(63) Continuation of application No. 11/706,143, filed on Feb. 13, 2007, now Pat. No. 7,631,707.

(60) Provisional application No. 60/787,139, filed on Mar. 29, 2006.

(51) Int. Cl.
*E21B 7/04* (2006.01)

(52) U.S. Cl. ..... 175/73; 175/61

(58) Field of Classification Search ..... 175/40, 175/61, 73; 148/402

See application file for complete search history.

(56) References Cited

U.S. PATENT DOCUMENTS 6,216,779 B1 * 4/2001 Reinhardt ..... 166/57
2005/0109542 A1 * 5/2005 Downton ..... 175/73

* cited by examiner

*Primary Examiner* — William P Neuder
*Assistant Examiner* — Sean Andrish
(74) *Attorney, Agent, or Firm* — Claude E. Cooke, Jr.; John J. Love; Cooke Law Firm

(57) ABSTRACT

A rotary steerable apparatus is provided having an actuator for pushing the bit or pointing the bit that includes a shape memory alloy. An elongated form of the alloy, such as a wire or rod, is employed in a mechanism that applies force in a direction transverse to the wellbore in response to a change in length of the alloy. Temperature of the alloy is controlled to change shape and produce the desired force on pads for operating the apparatus. The apparatus may be used with downhole power generation and control electronics to steer a bit, either in response to signals from the surface or from downhole instruments.

11 Claims, 5 Drawing Sheets

SHAPE MEMORY ALLOY ACTUATED STEERABLE DRILLING TOOL

The application claims the benefit of U.S. Provisional Application No. 60/787,139, filed Mar. 29, 2006. This application is a continuation application of Ser. No. 11/706,143, filed Feb. 13, 2007, now U.S. Pat. No. 7,631,707 B2.

BACKGROUND OF INVENTION

1. Field of the Invention

This invention pertains to drilling of wells in the earth. More particularly, apparatus and method are provided for controlling the direction of a drill bit using a Rotary Steerable System (RSS) having a shape memory alloy (SMA) for applying the controlling force.

2. Description of Related Art

Directional drilling in the earth has become very common in recent years. A variety of apparatus and methods are used. Hydraulic motors driven by a drilling fluid pumped down the drill pipe and connected to a drill bit have been widely used. Directional control is achieved by using a "bent sub" just above or below the motor and other apparatus in a bottom-hole assembly. In this mode of drilling the drill pipe is not rotated while direction is being changed; it slides along the hole. More recently, the use of "Rotary Steerable Systems" (RSSs) has grown. These systems are of two common types: "push-the-bit" and "point-the-bit" systems. The drill pipe rotates while drilling, which can be an advantage is many drilling situations such as, for example, when sticking of drill pipe is a risk.

An RSS using the "point-the-bit" method is disclosed in U.S. Pat. No. 6,837,315. The system includes a power generation section, an electronics and sensor section and a steering section. In the power generating system, a turbine driven by the drilling fluid drives an alternator. The electronics and sensor section includes a variety of directional sensors and other electronic devices used in the tool. In the steering section, the shaft driving the bit is supported within a collar and a variable bit shaft angulating mechanism, having a motor, an offset mandrel and a coupling, is used to change the direction of the bit attached to the shaft. Similar power generation and electronics sections are common to many rotary steerable systems.

An RSS using the "push-the-bit" method is disclosed in U.S. Pat. No. 6,116,354. Thrust pistons are attached to pads and when the thrust pistons are actuated the pad is kicked against the wall of the borehole. Hydraulic fluid driving the pistons is controlled by a battery-driven solenoid.

A simpler and more reliable actuation mechanism is needed for driving the mechanisms of both "point-the-bit" and "push-the-bit" systems. This mechanism should provide the force necessary for a wide range of drilling conditions.

BRIEF SUMMARY OF THE INVENTION

A Rotary Steerable System (RSS) is provided. Either a push-the-bit or point-the-bit mechanism is activated by a shape memory alloy that is changed in length. The change in length, caused by temperature change of the alloy, is converted to transverse movement of a mechanism. The temperature of the alloy is controlled by electrical current in the alloy or by heating of material in proximity to the alloy.

DETAILED DESCRIPTION OF THE INVENTION

Figure 1:
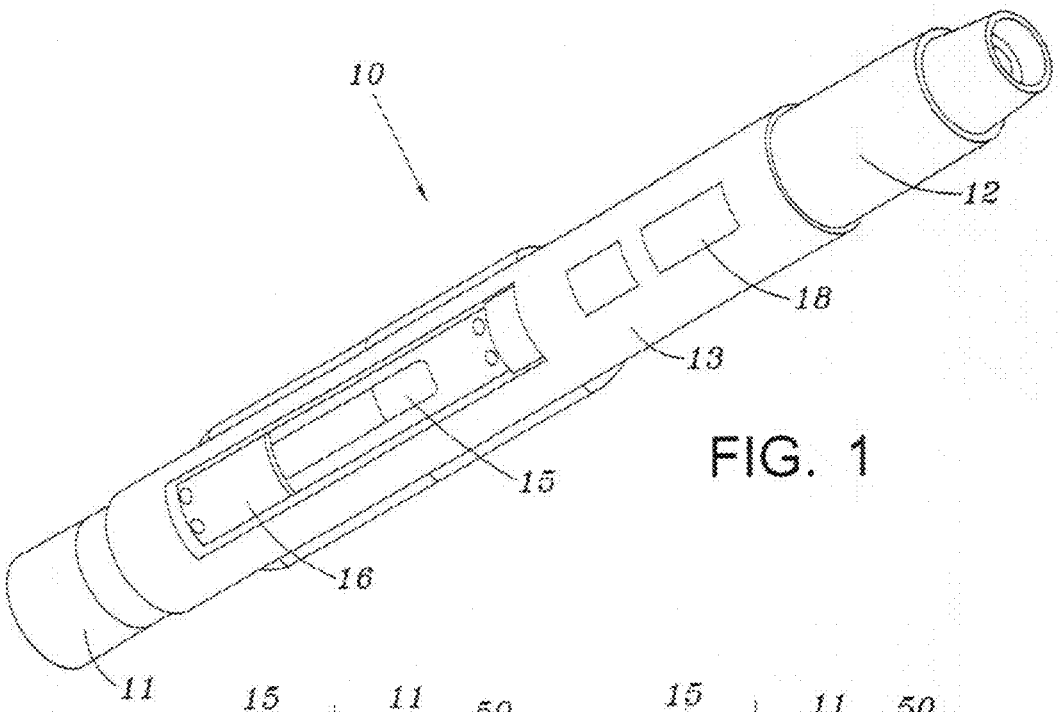
FIG. 1 is an isometric view of one embodiment of the rotary steerable drilling tool disclosed herein.

Referring to FIG. 1, an isometric view of rotary steerable tool 10 is shown. The tool consists of shaft 11, up-connection pin or box 12, non-rotating sleeve 13, three pads 15 (one shown), three hatch covers 16 (one shown) and electronics section 18. Shaft 11 may be connected to a drill bit and pin or box 12 may be connected to another segment of a bottom-hole assembly (BHA), which will be connected to the bottom of a string of drill pipe. Shaft 11 and connection pin or box 12 may rotate with the drill string while sleeve 13 is stationary.

Figure 2A:
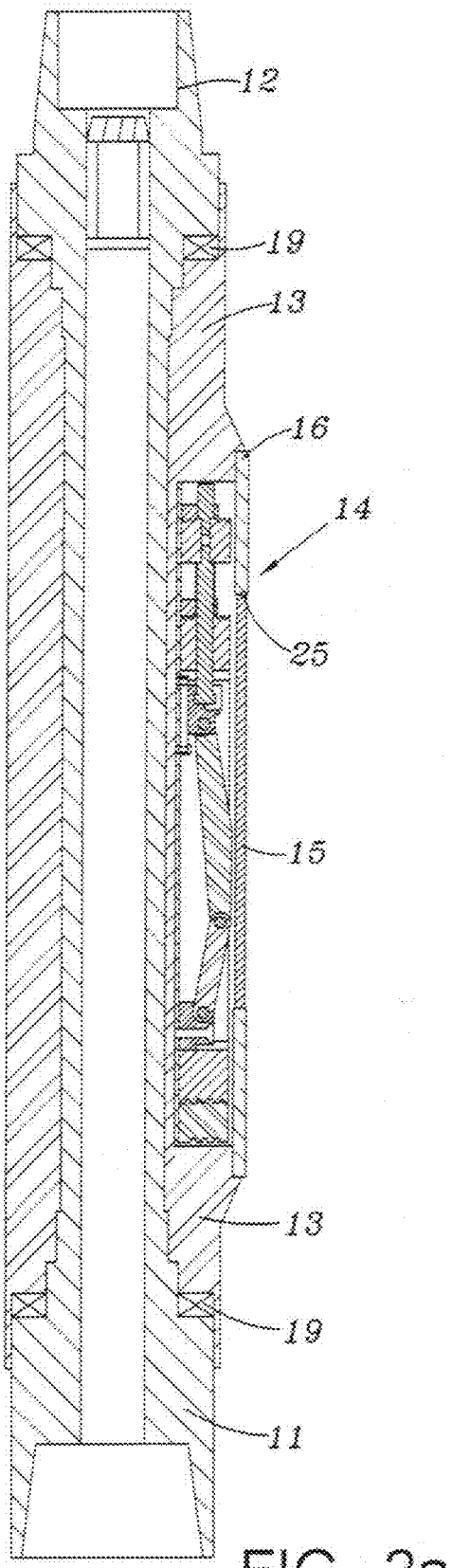
FIG. 2*a* is a section view of the rotary steerable drilling tool when not activated.
Figure 2B:
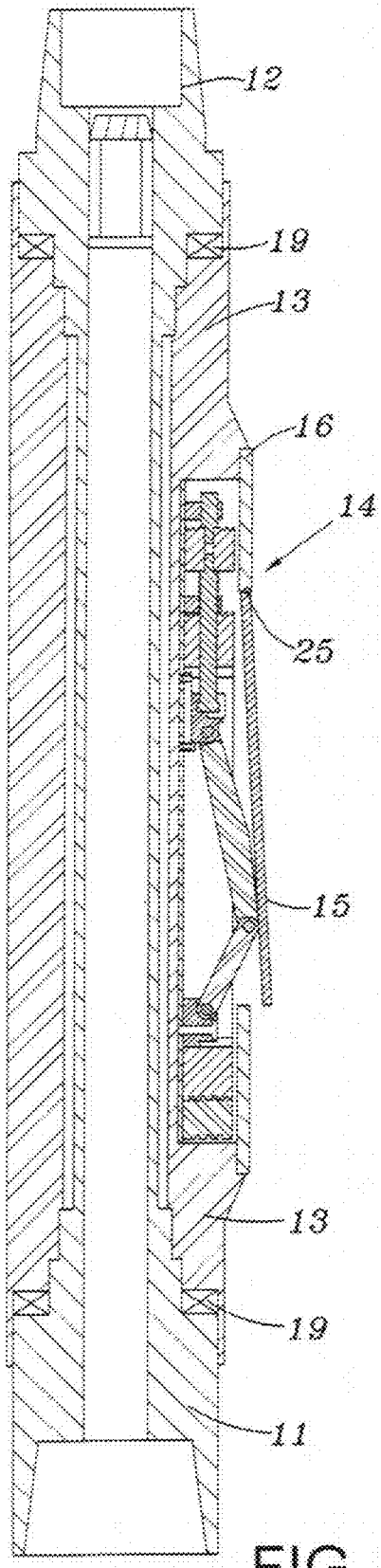
FIG. 2*b* is a section view of the tool when activated to push the bit.

Referring to FIG. 2*a*, sleeve 13 is constrained on shaft 11 through two bearing packs 19. Sleeve 13 does not rotate with shaft 11 during drilling, although slow rotation may occur. The three SMA actuator modules 14, which will be described in detail below, are bolted in the cavities evenly distributed along the circumference of sleeve 13. Above each SMA actuator module, hatch cover 16 is screwed on sleeve 13 for protection. Pad 15 is hinged on sleeve 13 with pin 25, and moves outwards as actuator 14 is being activated. In FIG. 2*b*, actuator 14 has been activated, forcing pads 15 outward. A bit attached to shaft 11 would thereby be forced in the opposite direction to movement of the pad, which would cause the creation of a curved trajectory of the borehole formed by the bit.

Shape Memory Alloy (SMA) is the family name of metals that have the ability to return to a predetermined shape when heated. Such materials are available from a variety of sources that may be identified with an internet search. When an SMA is cold, or below its transformation temperature, it has a very low yield strength and can be deformed quite easily into any new shape—which it will retain. However, when the material is heated above its transformation temperature it undergoes a change in crystal structure, which causes it to return to its original shape. During its phase transformation, the SMA either generates a large force against any encountered resistance or undergoes a significant dimension change when unrestricted. This characteristic of SMA is referred to as the "shape memory effect;" it enables SMAs to be used in solid-state actuators. There are SMAs having different transformation temperature, workout, and recovery strain. Fine adjustment of compositions of SMAs and manufacturing procedures will produce the desired properties of an SMA for specified applications. For the applications of the steering tool disclosed herein, the transformation temperature of SMA is chosen such that maximum ambient temperature is 20-30° C. below the transformation point of the material. Then the SMA can be activated only with the intentional addition of heat. The SMA can be heated by conducting electrical current through its length or by conduction effect of electrical heaters that are near or bonded to the SMA or by using environmental temperature, tool waste heat, drilling fluid temperature or a combination of sources. The SMA material used for the steering tool may be in the form of wires or rod. The dimensions and the number of the SMA wires or rods are chosen such that enough actuation force is ensured to push a drilling bit against the reaction resistance from side cutting. Due to the variety of the SMA forms and dimensions, there are various combinations of the SMA wires or rods suitable for the steering tool design. The example shown hereafter is just one of those possible design plans.

The SMA material to be used may be "trained" at a temperature above its transition temperature to have a length shorter than its length below the transition temperature. It is then installed in the RSS disclosed herein. When the material is heated above the transition temperature, length of the material decreases. In the embodiments discussed, this decrease in length is used to drive a pad or shaft in a direction transverse to the direction of the decrease in length.

Figure 3:
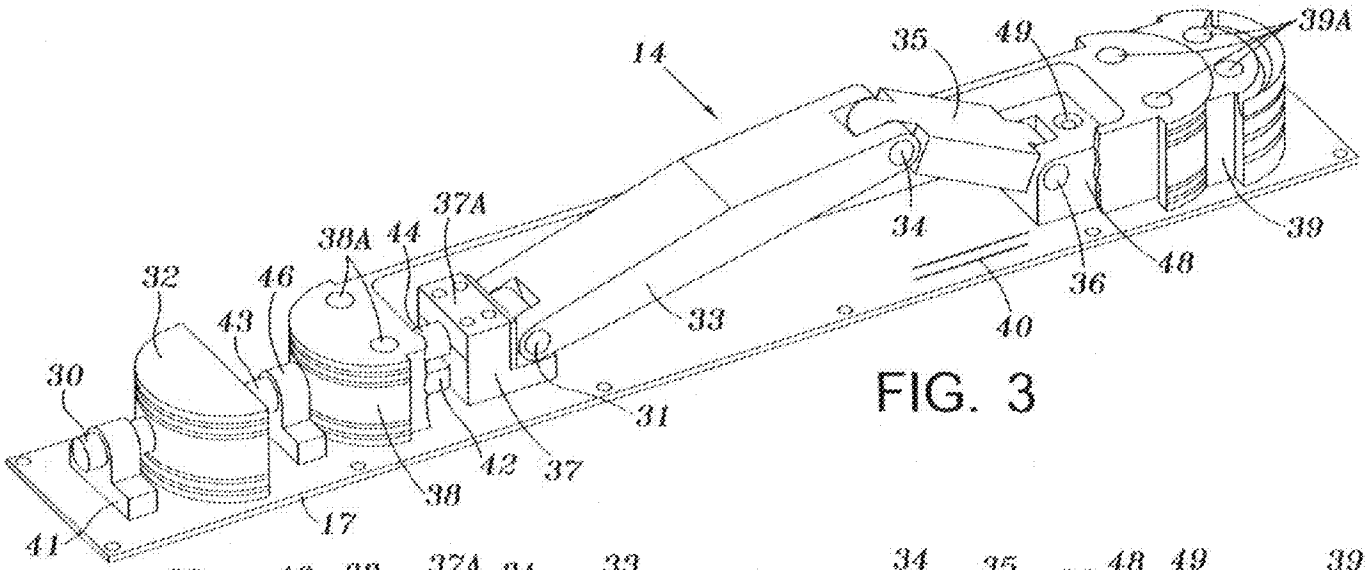
FIG. 3 is an isometric view of the SMA actuator module.
Figure 4A:
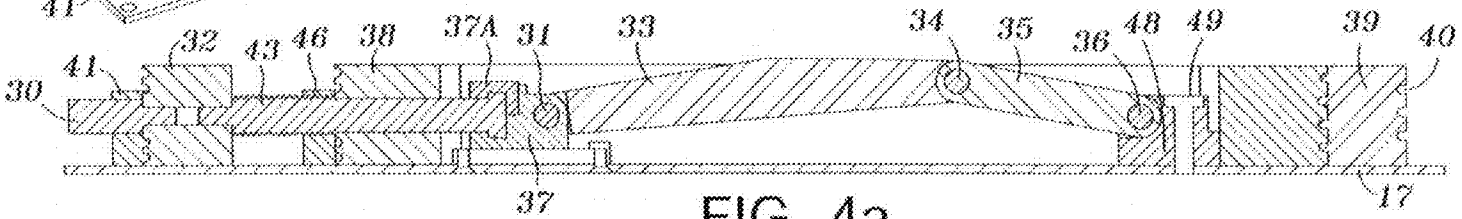
FIG. 4*a* is a section view of the SMA actuator module when not activated.
Figure 4B:
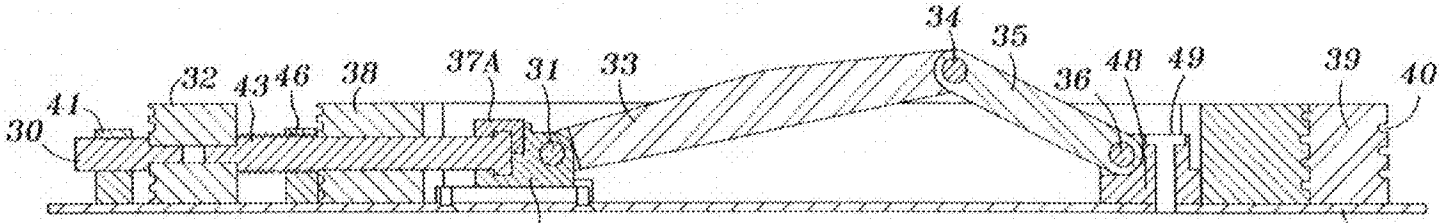
FIG. 4*b* is a section view of the activator when activated to exert a force.
Figure 9:
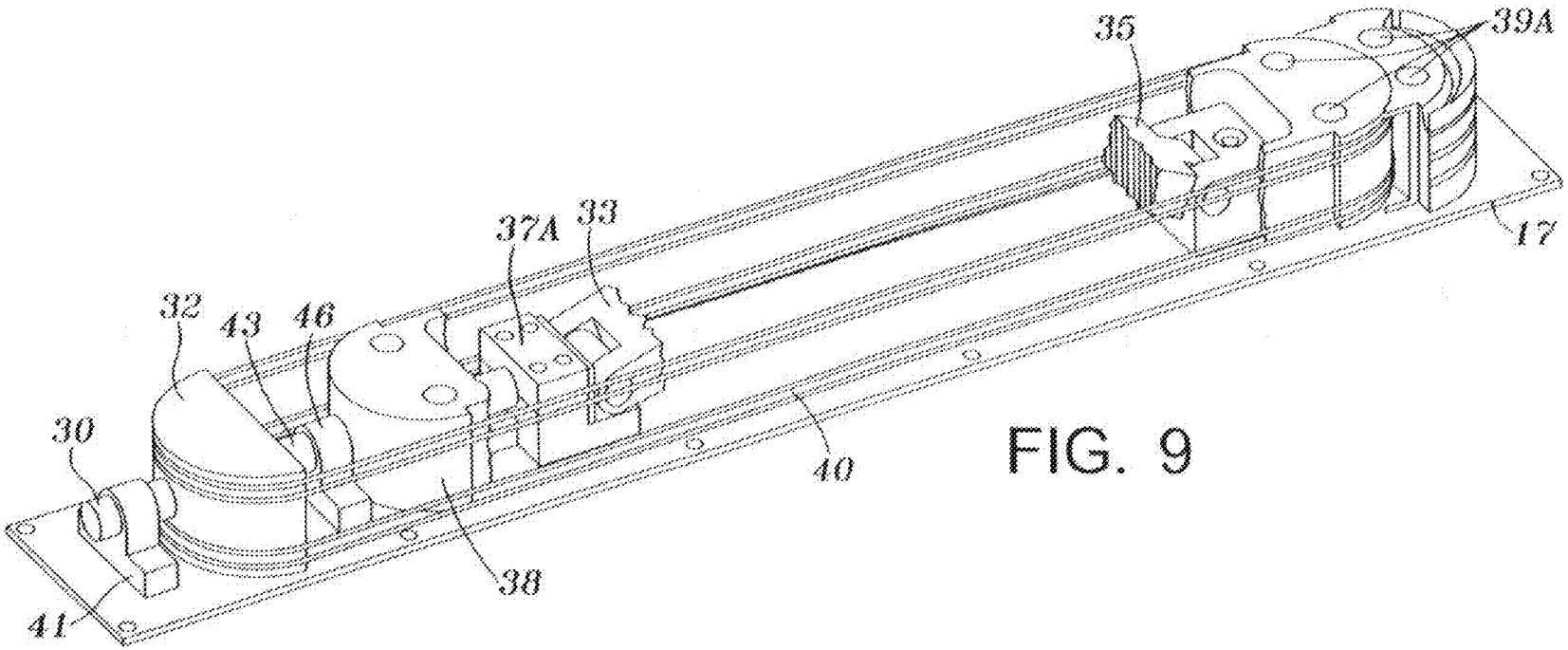
FIG. 9 is an illustration of the SMA wire wound about the guides.

A representative design of an actuator is shown in FIGS. 3-4, which is the same design as shown in FIG. 2. Referring to FIG. 3, the SMA actuator 14 comprises a linkage system (31, 33, 34, 35, and 36), a motion transmission system (30, 32, 44 and 37), and an SMA winding system (32, 38 and 39). Stationary Guide Rail 38 of the winding system is held in place by pins 38A. Guide 39 of the winding system is held in place by pins 39A. Only a short segment of SMA strand 40, which may be made of several thin SMA wires, is shown, to Provide greater clarity. Strand 40 winds around stationary guide rail 38 and movable guide rail 32 as shown in FIG. 9. The winding of SMA strand 40 and the its length are selected so that movable guide rail 32 slides a sufficient distance to ensure that pad 15 (FIG. 2*a*) may push against the wall of the wellbore with a selected displacement amplitude and magnitude of lateral force when SMA strand 40 is heated above its transition temperature. Spring 43 may be used to pre-tension SMA strand 40 before activation and to reset the SMA after deactivation. The linear sliding motion of rail 32 is transmitted to the movement of slider 37, spring 43 and rod 44. Rod 44 is connected to rail 32 and slider 37, and its movement is supported by bearing 46. Rod 30 is attached to rah 32, and slides on bearing 41. To ensure a smooth sliding of slider 37, sliding mail 42 is used to guide the slider. A long linkage 33 and short linkage 35 are hinged by a pin 34. The other end of linkage 35 is hinged to stand 48, which is bolted on sleeve 13 with bolt 49. Hence, linkage 35 only rotates about the in 36. Pin 31 connects slider 37 and long linkage 33 and allows linkage 33 to rotate relative to the slider. The lengths of the two linkages are chosen so that the pad moves a selected amount with a given displacement of rail 32. Various modifications of the linkage system can meet the displacement amplification requirement. Stationary Guide Rail 38 and Guide 39 are mounted on a plate member 17.

Upon electrical heating, which can be done by directly heating the SMA elements by passing electrical current through the elements or by using a heating element near or in contact with the SMA elements and/or using any other heat source available downhole, SMA strand 40 contracts as a result of crystal structure changes. The resultant contracting force overcomes the pre-tension force on spring 43 and pushes movable guide rail 32 toward stationary rail 38. Through the transmission chain consisting of the rod 44, slider 37 and linkages 33 and 35, the displacement of the rail 32 results in the transverse movement of pad 15. Comparison of the positions of the moving components in FIGS. 4*a* and 4*b* clearly illustrates the actuation mechanism.

The SMA material may be heated by a variety of methods. For example, an oil bath surrounding the SMA material may be heated electrically. Alternatively, a separate resistance wire in thermal contact with the SMA material may be heated to heat the SMA material.

Figure 5A:
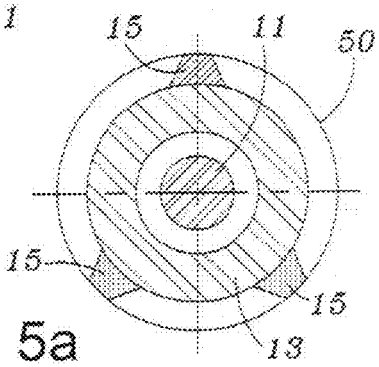
FIG. 5 is an illustration of the use of an SMA actuator to push a bit using pads on a sleeve.
Figure 5B:
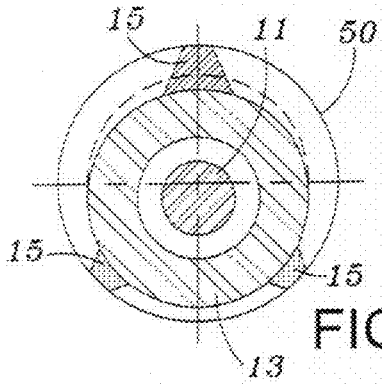

Referring to FIG. 5*a* and FIG. 5*b*, fully deployed pads 15 may be designed to extend outward to a diameter greater than the nominal diameter of the wellbore. As pads 15 touch wall-of-the-wellbore 50, they may be not fully activated, and continuously heating of SMA strands 40 (FIG. 3) will produce large holding force on the pads. At this moment, pads 15 function like stabilizers, and sleeve 13 is stationary (not rotating). The combination of reaction forces from the three pads determines the steering force and direction. If the three forces are equal, a drill bit attached to shaft 11 remains at the center of the well, as illustrated in FIG. 5*a*. To make a deviation of the drilling trajectory, under command from the electronics package, a feedback control loop coded in the electronics may regulate the electrical current applied to the three actuators to adjust their actuation forces so that the combined reaction pushes the attached drill bit sideways (transverse to the axis of the wellbore) and in the desired direction, as shown in FIG. 5*b*. One or two pads may be activated to apply greater sideways force and one or two pads may be deactivated to an extent to apply less force. This steering approach is called the "push-the-bit" mode.

Figure 6A:
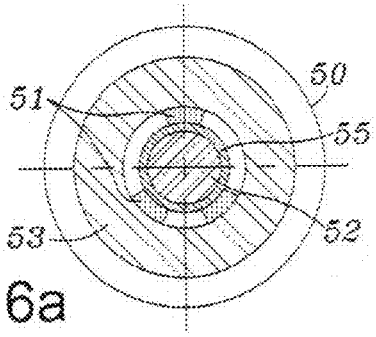
FIG. 6 is an illustration of the use of an SMA actuator to point a bit using a flexible shaft.
Figure 6B:
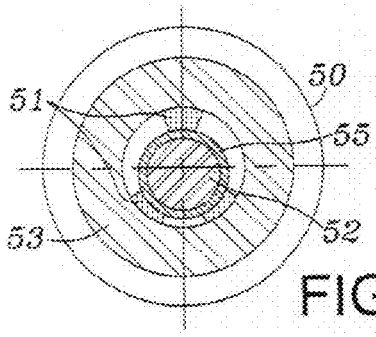

The SMA actuator may also be used for "point the bit" RSSs, as illustrated in FIGS. 6*a* and 6*b*. For this system, three steering pads 51 are directed inwards to apply sideways force between sleeve 53 and bearing 55, which supports shaft 52, instead of outwards to wall-of-the-wellbore 50. As illustrated in FIG. 6, as the three pads are deployed, they control the axial alignment of the shaft by means of bearing 55. Similar to the former, the resultant steering force may be applied to shaft 52 to cause FIG. 6*b* to point the bit for deviation of the wellbore, as shown.

Figure 7:
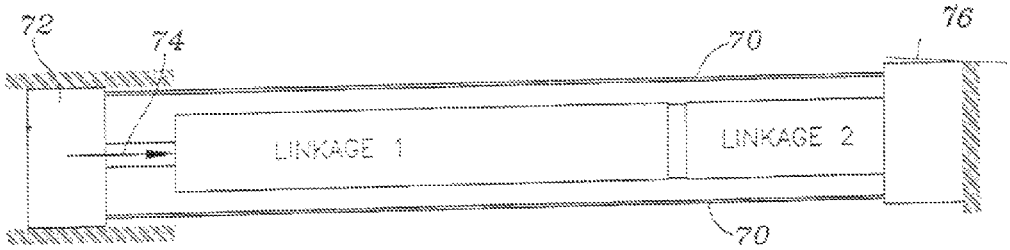
FIG. 7 is a schematic of an actuator design with straight SMA wires or rods.
Figure 8:
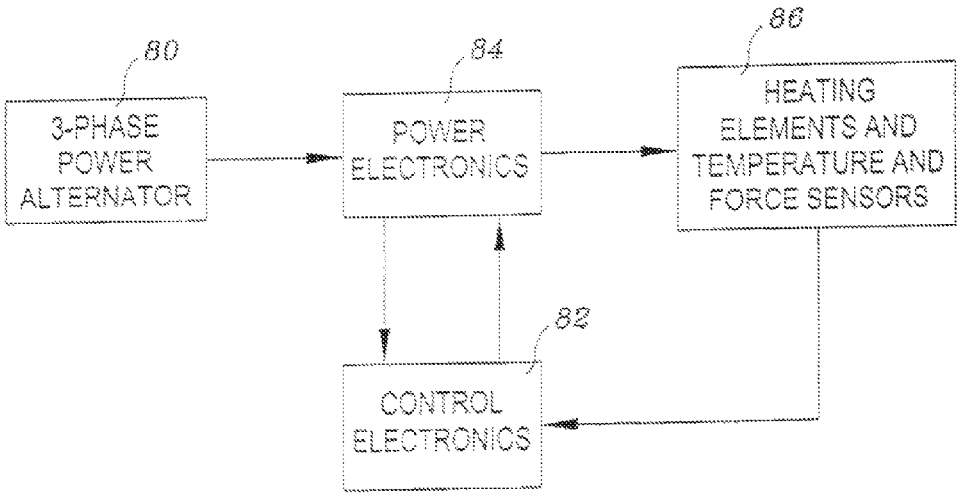
FIG. 8 is a block diagram of a directional drilling system using SMA actuators. The same part is identified by the same numeral in each drawing.

The SMA used to generate the actuation force can be used in different combinations and arrangements, including SMA rods, wires, cables, pre-formed elements, and/or a combination thereof to achieve different forces, different expansion and contraction lengths, different stroke lengths and different actuation cycle times for generation of force and for the subsequent relaxation period of the SMA. The direction of the generated force can also be varied by using different assemblies of pulleys, linkages, levers, springs, rods, in different forms and combinations. For example, the schematic in FIG. 7 shows an actuator using straight SMA wires or rods 70 instead of strands of SMA materials that pass around pulleys. The wires or rods are attached at one end to slider 72 and at the other end to support 76. The linkage system remains, but the actuator force comes from two groups of SMA wires or rods symmetrically placed at the two sides of the linkage system. The linkage system is moved by rod 74, which is attached to slider 72. Without pulleys, this design eliminates the potential friction of the SMA wires and the rail used in the alternate embodiment, and requires more strain recovery capability of SMA materials.

The same principle of generating a substantial force using SMA material in different forms and shapes and alloys and combinations thereof, can also be used in different temperature ranges and environments; for example, the actuator unit disclosed herein may be used as a valve actuator or for other applications.

The disclosed system when used for rotary steerable drilling may be controlled with an algorithm, as illustrated in FIG.

8. The electrical current to heat the SMA may come from 3-phase alternator 80, which may be either driven by a turbine from drilling fluid flow or from relative rotation of shaft 11 in stationary sleeve 13 (FIG. 1) of a drilling assembly. Closed loop control system 82 controls the steering of the device, which may receive downlink commands using well known methods such as industry standard mud pulse telemetry or drill string rpm coding. Once the tool receives commands from the surface, electronics package 84 and software work to immediately implement automatic steering continuously, using heating elements and temperature and force sensors 86, until another command is sent. Alternatively, commands may not be downlinked from the surface but may be generated when downhole instruments that measure direction of the bit, such as an accelerometer and gyroscope or magnetometer, compare that direction to a pre-selected direction and send a signal to the rotary steerable system disclosed herein.

Although the present invention has been described with reference to specific details, it is not intended that such details should be regarded as limitations on the scope of the invention, except as and to the extent that they are included in the accompanying claims.

What we claim includes:

1. A rotary steerable drilling apparatus for drilling a wellbore, comprising:

a shaft adapted for joining to a drill string;

a sleeve concentric with the shaft, the shaft being free to rotate within the sleeve;

a plurality of individually operable actuator modules fixed to the sleeve, the modules comprising a shape memory alloy formed such that a change in temperature of the alloy within a selected range of temperature causes the alloy to change from a first dimension to a second dimension;

a plurality of pads in proximity to the actuator modules and adapted to apply a force to a selected wall of the wellbore in response to the change of the alloy from the first to the second dimension, the shape memory alloy being mechanically coupled to a linkage which exerts an outward force on the pads when the shape memory alloy is actuated.

2. The rotary steerable drilling apparatus of claim 1 wherein the shape memory alloy is in the form of a wire.

3. The rotary steerable drilling apparatus of claim 1 wherein the shape memory alloy is in the form of a rod.

4. The rotary steerable drilling apparatus of claim 1 wherein the change of the from the first to the second dimension causes a transverse motion in the actuator modules.

5. The rotary steerable drilling apparatus of claim 1 wherein the actuator modules comprise linkage systems adapted to move outwardly from the sleeve in response to the change in dimension of the alloy.

6. The rotary steerable drilling apparatus of claim 1 further comprising a heating element in contact or in proximity with the shape memory alloy.

7. A rotary steerable drilling system, comprising:

the rotary steerable drilling apparatus of claim 1 further comprising a downhole electrical power generator, electronics for controlling the electrical power generated, sensors for measuring force on the pads and electronics for controlling force applied to the pads.

8. The rotary steerable drilling apparatus of claim 1 wherein each of the actuator modules includes a support and a slider, and a plurality of wire segments extending between the support and the slider, the wires being formed of a shape memory alloy.

9. The rotary steerable drilling apparatus of claim 8 further including a long linkage and a short linkage, a first end of the long linkage being pivotably attached to the slider, a second end of the long linkage being pivotably attached to the short linkage at one end thereof, and the other end of the short linkage being pivotably attached to the support.

10. The apparatus of claim 9 wherein the support and the slider are attached to a plate, the plate being secured to the sleeve.

11. The rotary steerable drilling apparatus of claim 1 wherein each of the actuator modules includes a support and a slider, and a plurality of rod segments extending between the support and the slider, the rod segments being formed of a shape memory alloy.

* * * * *